United States Patent [19]

Tosaka et al.

[11] Patent Number: 4,985,177

[45] Date of Patent: Jan. 15, 1991

[54] CONTAINING A SUCCINIC ACID DERIVATIVE

[75] Inventors: Masaki Tosaka; Haruki Kawano; Katsuhiko Deguchi, all of Utsunomiya, Japan

[73] Assignee: Kao Corporation, Tokyo, Japan

[21] Appl. No.: 417,038

[22] Filed: Oct. 4, 1989

[30] Foreign Application Priority Data

Oct. 21, 1988 [JP] Japan ..... 63-265719

[51] Int. Cl.[5] ..... C11D 1/831; C11D 1/04

[52] U.S. Cl. ..... 252/547; 252/548; 252/551; 252/554; 252/555; 252/558; 252/559; 252/174.19; 252/DIG. 14

[58] Field of Search ..... 252/548, 550, 558, 559, 252/174.19, DIG. 14

[56] References Cited

U.S. PATENT DOCUMENTS

| | | | |
|---|---|---|---|
| 4,277,378 | 7/1981 | Tsujii et al. | 252/546 |
| 4,486,388 | 12/1984 | Ootani et al. | 252/545 |
| 4,714,565 | 12/1987 | Wevers et al. | 252/174.19 |
| 4,744,916 | 5/1988 | Adams et al. | 252/99 |
| 4,857,213 | 8/1989 | Caswell | 252/8.75 |

FOREIGN PATENT DOCUMENTS

| | | |
|---|---|---|
| 0028850 | 5/1981 | European Pat. Off. . |
| 223306 | 5/1987 | European Pat. Off. . |
| 0264977 | 4/1988 | European Pat. Off. . |
| 0193398 | 11/1984 | Japan . |
| 2208297 | 3/1989 | United Kingdom . |

*Primary Examiner*—Prince E. Willis

*Attorney, Agent, or Firm*—Oblon, Spivak, McClelland, Maier & Neustadt

[57] ABSTRACT

A concentrated detergent composition comprising the following components (a)-(d) was disclosed, (a) a sulfate anionic or sulfonate anionic surface active agent, (b) a nonionic or amphoteric surface active agent, (c) a succinic acid derivative represented by the following formula (I):

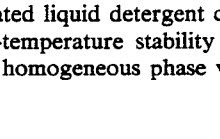

(I)

(d) a lower alkylbenzenesulfonate represented by the following formula (II):

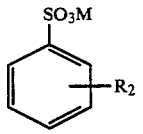

(II)

The concentrated liquid detergent composition has an excellent low-temperature stability and is capable of maintaining a homogeneous phase when thawed after frozen.

4 Claims, No Drawings

CONTAINING A SUCCINIC ACID DERIVATIVE

BACKGROUND OF THE INVENTION

1. Field of the Invention

The present invention relates to a concentrated liquid detergent composition having an excellent low-temperature stability and capable of maintaining a homogeneous phase when thawed after frozen.

2. Description of the Background Art

Owing to the wider popularity in recent years of small, light weight, compact products for household use such as detergents, smaller, more compact types of powdery heavy duty detergents and softeners comprising higher concentration active components are achieving greater sales. In spite of a great deal of advantage in small-volume products of dishwashing detergents, shampoos, etc. because of their everyday use, there are few concentrated, small-volume products on the market.

Liquid detergent compositions conventionally comprise as a major detergent component anionic surface active agents which are superior in their detergency and foaming capability. They further comprise nonionic or amphoteric surface active agents as an auxiliary agent for supplementing the detergency and foaming capability, and for decreasing irritation to the skin. Beside detergency and foaming capability, characteristics demanded of liquid detergent compositions include low-temperature stability, i.e., the outward appearance should not change and the liquid should be stably maintained when the detergent compositions are exposed to a low temperature.

Increasing the concentration of surface active agents in a liquid detergent composition, however, impairs the stability of the composition and makes the liquid composition turbid during storage at a low temperature. If such a liquid detergent composition is once frozen at a temperature below −10° C., the liquid becomes turbid when thawed and does not restore its original transparency until the temperature is raised above 10° C. To eliminate this problem, a hydrotroping agent such as ethanol, urea, and the like is added. However, a large amount of hydrotroping agent must be added to a liquid detergent composition containing a surface active agent at a concentration of 40% by weight or more. This causes problems such as increased flammability, objectionable odors, disagreeable foams produced by the composition, an increase in the pH during passage of time, and the like. In addition, a sufficient result in the transparency recovery of the frozen composition could not be obtained by the addition of a hydrotroping agent.

In view of the situation, the present inventors have undertaken extensive studies and found that a high-concentration liquid detergent composition comprising an anionic surface active agent and nonionic or amphoteric surface active agent at a specific ratio, and further comprising specific types of succinic acid derivative and lower alkylbenzenesulfonate, was stable at a low temperature and maintained a homogeneous phase when frozen and restored to the liquid state. Such findings have led to the completion of the present invention.

SUMMARY OF THE INVENTION

Accordingly, an object of this invention is to provide a concentrated detergent composition comprising the following components (a)-(d):

(a) a sulfate anionic or sulfonate anionic surface active agent, (b) a nonionic or amphoteric surface active agent, (c) a succinic acid derivative represented by the following formula (I):

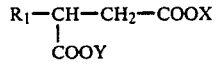

$$R_1-\underset{\underset{COOY}{|}}{CH}-CH_2-COOX \quad (I)$$

wherein $R_1$ is an alkyl or alkenyl group having 10–14 carbon atoms, X and Y individually represents a hydrogen atom, an alkali metal, an ammonium ion, or an alkanol amine, and (d) a lower alkylbenzenesulfonate represented by the following formula (II):

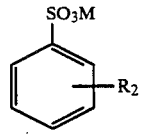

(II)

wherein $R_2$ is a hydrogen atom or an alkyl group having 1–5 carbon atoms, M represents an alkali metal, an ammonium ion, or an alkanol amine; and wherein the content of (a)+(b) is 40–60% by weight, the ratio by weight of (a)/(b) is 0.5–10, the ratio by weight of (d)/(c) is 2–20, and the ratio by weight of [(c)+(d)]/[(a)+(b)]is 0.05–0.3.

Other objects, features and advantages of the invention will hereinafter become more readily apparent from the following description.

DETAILED DESCRIPTION OF THE INVENTION AND PREFERRED EMBODIMENTS

Given as examples of sulfate- or sulfonate-type anionic surface active agents which are component (a) of the present invention are linear alkyl ($C_{10-16}$) benzenesulfonates, polyoxyethylene (average EO=1–5 mol) alkyl ($C_{10-16}$) ethersulfates, α-olefin ($C_{10-16}$) sulfonates, alkane ($C_{10-18}$) sulfonates, and the like. These surface active agents can be used either individually or in combination.

Included in nonionic or amphoteric surface active agents which are component (b) of this invention are the following compounds:

Nonionic surface active agents such as polyoxyethylene (average EO=3–20 mol) alkyl ($C_{10-18}$) ethers, higher fatty acid ($C_{10-18}$) alkanolamide; tert-amine oxide represented by the formula (III):

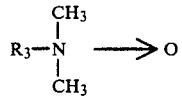

$$R_3-\overset{\overset{CH_3}{|}}{\underset{\underset{CH_3}{|}}{N}} \longrightarrow O \quad (III)$$

wherein $R_3$ is an alkyl or alkenyl group having 10–14 carbon atoms; amphoteric surface active agents such as alkylbetaine, alkylamidebetaine, or alkylsulfobetaine represented by the formulae (IV), (V), or (VI):

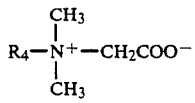

$$R_4-\overset{\overset{CH_3}{|}}{\underset{\underset{CH_3}{|}}{N^+}}-CH_2COO^- \quad (IV)$$

-continued

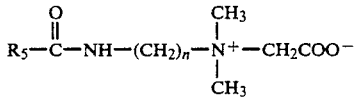

(V)

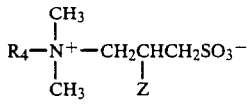

(VI)

wherein $R_4$ is an alkyl or alkenyl group having 10–18 carbon atoms, $R_5$ is an alkyl or alkenyl group having 9–17 carbon atoms, and Z is a hydrogen atom or a hydroxyl group. These nonionic or amphoteric surface active agents can be used either individually or in combination.

It is necessary that components (a) plus (b) be contained in the composition in an amount of 40–60% by weight. If the amount is smaller than 40% by weight, a concentrated liquid detergent composition cannot be obtained, while at a concentration of greater than 60% by weight, stability of the composition is impaired. It is also necessary that the ratio by weight of (a)/(b) be in the range of 0.5–10 with the preferable ratio being in the range of 0.5–5. If the ratio is outside this range, not only the stability is impaired, but also the basic performances of a detergent composition, i.e., the detergency and foaming capability, are adversely affected.

Several detergent compositions including succinic acid derivatives which are component (c) of the present invention are known in the art. These are, for example, a detergent composition comprising a succinic acid derivative having an alkyl or alkenyl group of a $C_{8-18}$ carbon atom content (Japanese Patent Laid-open No. 142099/1980), a detergent composition comprising a succinic acid derivative having an alkyl or alkenyl group of a $C_{4-14}$ carbon atom content together with a lower alcohol and further comprising an alkaline builder as a solubilizing agent (Japanese Patent Laid-open No. 142603/1975), a liquid detergent composition using a succinic acid having an alkyl or alkenyl group of a $C_4$–8 carbon atom content for improving low-temperature stability and preventing film from forming (Japanese Patent Laid-open Nos. 196299/1983 and 196296/1983), and the like. There has been no literature, however, reporting that a succinic acid derivative having a relatively long-chain alkyl or alkenyl group represented by formula (I) is effective for restoring the original state of a liquid detergent composition after freezing and thawing. Nor has a report ever surfaced discussing a remarkable improvement in low-temperature stability and the restoration capability of a detergent after freezing and thawing obtained by the use of such a succinic acid derivative in conjunction with the (d) component of the present invention.

In this invention, it is imperative that the (c) component succinic acid derivative have 10–14 carbon atoms for $R_1$. If the carbon atoms are less than 10, the effect of low-temperature stability and the restoration capability of a detergent after freezing and thawing is small. If more than 14, on the other hand, the low temperature-stability becomes even worse because of decreased solubility of the succinic acid derivative.

Among lower alkylbenzenesulfonates represented by the formula (II), the (d) component of the present invention, only those having a hydrogen atom or an alkyl group having 1–5 carbon atoms for $R_2$ of formula (II) are effective and exhibit low-temperature stability and the restoration capability of a detergent after freezing and thawing when used in conjunction with the (c) component. If the carbon atom content is greater than 5, these effects are greatly impaired.

In the liquid detergent composition of the present invention, the ratio by weight of (d)/(c) is 2–20 and the ratio by weight of [(c)+(d)]/[(a)+(b)] is 0.05–0.3. If the ratios are outside these ranges, a sufficient effect in the detergent capability to restore its original transparent state after freezing and thawing cannot be obtained.

In addition to the above essential components, various components which are commonly used in liquid detergent compositions can be formulated as required to the extent inclusion of such components do not adversely affect the effect intended in the present invention. Such optional components include, for example, lower alcohols, e.g. ethanol, isopropanol; polyols, e.g. ethylene glycol, propylene glycol, polyethylene glycol; hydrotroping agent, e.g. urea; pH buffering agents, e.g., citric acid, malic acid; natural fruit juice, e.g., lemon, lime; as well as skin protecting agents, enzymes, protein derivatives, coloring agents, perfumes, preservatives, and the like.

Water molecules in an aqueous solution of a surface active agent exist in the form of bound water in which water molecules are bound to surface active agent molecules and free water which is not bound to a surface active agent. Bound water does not freeze at a temperature of about −20° C. which is considered to be the lower limit of storage conditions in winter in cold districts. Only free water freezes at such a temperature. Therefore, in the course of water freezing and thawing at −20° C., only freezing and thawing of free water occurs. Concentrations of surface active agents vary depending on the locations in the container on account of variations in specific gravities of free water and bound water containing a surface active agent at varied concentrations. This causes the surface active agent to be highly concentrated at the bottom of the container. Liquid crystal structures and gel structures of a surface active agent change in the course of such concentration, making the liquid detergent composition turbid and further making it impossible for the liquid detergent composition to restore its original transparency when thawed.

This inability of liquid detergent compositions to restore its transparency could not be resolved by the use of conventional hydrotroping agents such as lower alcohols (e.g. ethanol), polyols (e.g. polyethylene glycol), or urea. They bring about only a small effect or no effect at all. Succinic acid derivatives of the present invention are presumed, owing to the hydrophobic group contained in the molecule, to join with associated structures of surface active agents which are the major components of a detergent and to form mixed micells. The mixed micells are considered to prevent liquid crystal structures and gel structures from forming when a frozen liquid detergent composition is thawed. Such micells are produced more easily by the use of such a succinic acid derivative having a long-chain alkyl or alkenyl group and possessing a strong surface activity as defined in this invention. Such a succinic acid derivative is expected to produce micells and exhibits their effects even in a small amount. A long-chain succinic acid derivative, however, has limited solubility in a solution. The amount of the compound exceeding the soluble limit involves solid deposition and makes the liquid detergent composition become turbid. Independent use of a succinic acid derivative therefore does not provide a satisfactory result.

The combined use of a long-chain succinic acid derivative and a lower alkylbenzenesulfonate at a specific ratio in this invention, ensures improved solubility of a long-chain succinic acid derivative in a detergent composition, and effectively prevents solid precipitates from forming and liquid detergent compositions from becoming turbid. The liquid detergent composition of the present invention to which a small amount of these compounds are formulated exhibits an outstanding low-temperature stability and a remarkably improved effect of restoring the original transparent state when a frozen liquid detergent composition thaws.

Other features of the invention will become apparent in the course of the following description of the exemplary embodiments which are given for illustration of the invention and are not intended to be limiting thereof.

EXAMPLES

The tests were conducted according to the following methods:

Low-temperature Stability

A composition was placed in 100 ml of a glass cylinder and stored at −5° C. in a thermostat for 10 days. The appearance of the composition was measured according to the following criteria.

AAA: No change in appearance
BBB: Turbidity was observed
CCC: Separation or precipitation occurred

Freeze-thaw property

A composition which was placed in 100 ml of a glass cylinder was stored at −20° C. in a thermostat for one day and then at 10° C. in the thermostat for one day. This freeze-thaw operation was repeated 3 times. The appearance of the composition was measured at 10° C. according to the following criteria.

AAA: No change in appearance
BBB: Turbidity was observed
CCC: Separation or precipitation occurred

TABLE 1

| | Inventive composition | | | | | | |
|---|---|---|---|---|---|---|---|
| | 1 | 2 | 3 | 4 | 5 | 6 | 7 |
| Component | Wt % | Wt % | Wt % | Wt % | Wt % | Wt % | Wt % |
| Sodium polyoxyethylene(3) dodecylethersulfate | 25 | — | — | — | 15 | 15 | 15 |
| Sodium dodecylbezenesulfonate | — | 15 | — | — | 15 | — | — |
| Sodium α-olefinesulfonate (Average molecular weight: 326) | — | — | 20 | — | — | 15 | — |
| Sodium octadecanesulfonate (Average molecular weight: 356) | — | — | — | 20 | — | — | 15 |
| Polyoxyethylene(12) dodecylether | 10 | 10 | 10 | 10 | — | — | — |
| Coconut oil fatty acid diethanolamide | 10 | 15 | 10 | 10 | 10 | 10 | 10 |
| Dodecyldimethylamine oxide | — | — | — | — | 1 | 2 | 2 |
| Sodium dodecenylsuccinate | 1 | 2 | 2 | 2 | 0.5 | 0.5 | 0.5 |
| Sodium p-toluenesulfonate | 5 | 6 | 6 | 6 | 4 | 4 | 4 |
| Ethanol | 5 | 5 | 5 | 5 | 5 | 5 | 5 |
| Tap water | Balance | Balance | Balance | Balance | Balance | Balance | Balance |
| Low temperature stability | AAA | AAA | AAA | AAA | AAA | AAA | AAA |
| Freeze-thaw property | AAA | AAA | AAA | AAA | AAA | AAA | AAA |
| | 8 | 9 | 10 | 11 | 12 | 13 | 14 |
| Component | Wt % | Wt % | Wt % | Wt % | Wt % | Wt % | Wt % |
| Sodium polyoxyethylene(3) dodecylethersulfate | 25 | — | — | — | 10 | 15 | 15 |
| Sodium dodecylbezenesulfonate | — | 15 | — | — | 10 | — | — |
| Sodium α-olefinesulfonate (Average molecular weight: 326) | — | — | 20 | — | — | 15 | — |
| Sodium octadecanesulfonate (Average molecular weight: 356) | — | — | — | 20 | 10 | — | 15 |
| Polyoxyethylene(12) dodecylether | 10 | 10 | 10 | 10 | — | — | — |
| Coconut oil fatty acid diethanolamide | 10 | 15 | 10 | 10 | 10 | 10 | 10 |
| Dodecyldimethylamine oxide | — | — | — | — | 1 | 2 | 2 |
| Sodium dodecenylsuccinate | 1 | 2 | — | — | — | — | — |
| Sodium p-toluenesulfonate | — | — | 6 | 6 | — | — | — |
| Ethanol | 5 | 5 | 5 | 5 | 5 | 5 | 5 |
| Tap water | Balance | Balance | Balance | Balance | Balance | Balance | Balance |
| Low temperature stability | BBB | BBB | BBB | BBB | CCC | CCC | CCC |
| Freeze-thaw property | CCC | CCC | CCC | CCC | CCC | CCC | CCC |

Example 1

Liquid detergent compositions having the formulations shown in Table 1 were prepared. The low-temperature stability of the compositions and the restoring property to the original transparent state when a frozen liquid detergent composition thawed (this property is hereinafter referred to as "freeze-thaw property") were determined. The result is shown in Table 1.

Example 2

Liquid detergent compositions having the formulation listed below were prepared. The low-temperature stability and the freeze-thaw property of the compositions were measured. The results are shown in Table 2.

| Component | Formulation (wt %) |
|---|---|
| Sodium polyoxyethylene(4)dodecyl-ethersulfate | 20 |
| Sodium dodecylbenzenesulfonate | 15 |
| Lauroyl diethanolamide | 8 |
| Polyoxyethylene(12)dodecylether | 5 |
| Succinic acid derivative *1 | 1 |
| Lower alkylbezenesulfonate *1 | 5 |
| Ethanol | 5 |
| Water | Balance |

*1 See Table 2

TABLE 2

| Component | Succinic acid derivative $R_1-CH(COOY)-CH_2-COOX$ $R_1$ | X | Y | Lower alkylbenzenesulfonate $R_2$ | M | Low-temperature Stability | Freeze-thaw property |
|---|---|---|---|---|---|---|---|
| Inventive composition | | | | | | | |
| 15 | $C_{10}H_{21}$ | Na | Na | H | Na | AAA | AAA |
| 16 | $C_{12}H_{23}$ | K | K | $CH_3$ | Na | AAA | AAA |
| 17 | $C_{14}H_{27}$ | $NH_4$ | $NH_4$ | $CH_3$ | $NH_4$ | AAA | AAA |
| 18 | $C_{12}H_{23}$ | K | K | $C_3H_7$ | Na | AAA | AAA |
| 19 | $C_{12}H_{23}$ | Na | Na | $C_5H_{11}$ | K | AAA | AAA |
| Comparative composition | | | | | | | |
| 20 | $C_{12}H_{23}$ | K | K | $C_8H_{17}$ | Na | BBB | CCC |
| 21 | $C_8H_{17}$ | Na | Na | $CH_3$ | Na | BBB | BBB |
| 22 | $C_{16}H_{31}$ | K | K | $CH_3$ | Na | CCC | BBB |
| 23 | $C_{18}H_{35}$ | K | K | H | Na | CCC | CCC |
| 24 | No addition | | | No addition | | CCC | CCC |

Example 3

Liquid detergent compositions having the formulation listed below were prepared. The low-temperature stability and the freeze-thaw property of the compositions were measured. The results are shown in Table 3.

| Component | Formulation (wt %) |
|---|---|
| (a) | |
| Sodium polyoxyethylene(4)dodecyl ethersulfate | 10 |
| Sodium dodecylbenzenesulfonate | 10 |
| Sodium hexadecanesulfonate | 10 |
| (b) | |
| Coconut oil fatty acid diethanolamide | 10 |
| Dodecyldimethylamine oxide | 2 |

-continued

| Component | Formulation (wt %) |
|---|---|
| (c) | |
| Potassium dodecenylsuccinate | See Table 3 |
| (d) | |
| Sodium p-toluenesulfonate | See Table 3 |
| Ethanol | 5 |
| Water | Balance |

TABLE 3

| Composition No. | (c) Potassium dodecenyl-succinate (%) | (d) Sodium p-toluene-sulfonate (%) | (d)/(c) | (c) + (d) / (a) + (b) | Low-temperature stability | Freeze-thaw property |
|---|---|---|---|---|---|---|
| Inventive Composition | | | | | | |
| 25 | 1 | 3 | 3 | 0.095 | AAA | AAA |
| 26 | 2 | 8 | 4 | 0.238 | AAA | AAA |
| 27 | 0.5 | 8 | 16 | 0.202 | AAA | AAA |
| Comparative Composition | | | | | | |
| 28 | 0.1 | 5 | 50 | 0.121 | CCC | CCC |
| 29 | 3 | 3 | 1 | 0.143 | CCC | CCC |
| 30 | 0.5 | 1.2 | 2.4 | 0.04 | CCC | BBB |
| 31 | 4 | 10 | 2.5 | 0.333 | BBB | CCC |
| 32 | — | — | — | — | CCC | CCC |

Obviously, numerous modifications and variations of the present invention are possible in light of the above teachings. It is therefore to be understood that within the scope of the appended claims, the invention may be practiced otherwise than as specifically described herein.

What is claimed is:

1. A concentrated liquid detergent composition comprising the following components (a)-(d):

(a) a sulfate anionic or sulfonate anionic surface active agent, (b) a nonionic or amphoteric surface active agent, (c) a succinic acid derivative represented by the following formula (I):

$$R_1-\underset{\underset{COOY}{|}}{CH}-CH_2-COOX \quad (I)$$

wherein $R_1$ is an alkyl or alkenyl group having 10-14 carbon atoms, X and Y individually represents a hydrogen atom, an alkali metal, an ammonium ion, or an alkanol amine, and (d) a lower alkylbenzenesulfonate represented by the following formula (II):

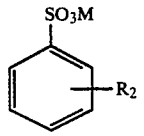

(II)

wherein $R_2$ is a hydrogen atom or an alkyl group having 1–5 carbon atoms, M represents an alkali metal, an ammonium ion, or an alkanol amine; and wherein the content of (a)+(b) is 40–60% by weight, the ratio by weight of (a)/(b) is 0.5–10, the ratio by weight of (d)/(c) is 2–20, and the ratio by weight of [(c)+(d)]/[(a)+(b)] is 0.05–0.3.

2. The concentrated liquid detergent composition of claim 1 wherein said anionic surface active agent is selected from the group consisting of linear alkyl $C_{10-16}$ benzene sulfonates, polyoxyethylene (average EO=1–5 mole) alkyl $C_{10-16}$ ether sulfates, α-olefin $C_{10-16}$ sulfonates, and alkane $C_{10-18}$ sulfonates or mixtures thereof.

3. The concentrated liquid detergent composition of claim 1 wherein the nonionic surface active agent is selected from the group consisting of polyoxyethylene (average EO=3–20 mole) alkyl $C_{10-18}$ ethers, fatty acid $C_{10-18}$ alkanolamides and tertiary-amine oxides represented by formula III

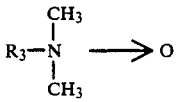

(III)

wherein $R_3$ is $C_{10-14}$ alkyl or alkylene group or mixtures thereof.

4. The concentrated liquid detergent composition of claim 1, wherein the ratio by weight of (a)/(b) is 0.5–5.0.

* * * * *